US008152698B1

(12) United States Patent
Chen

(10) Patent No.: US 8,152,698 B1
(45) Date of Patent: Apr. 10, 2012

(54) DUAL-MODE EXERCISE MACHINE

(75) Inventor: Tsung-Jen Chen, Chiayi Hsien (TW)

(73) Assignee: Cheng Long Machinery Co., Ltd., Chiayi Hsien (TW)

( * ) Notice: Subject to any disclaimer, the term of this patent is extended or adjusted under 35 U.S.C. 154(b) by 0 days.

(21) Appl. No.: 12/949,084

(22) Filed: Nov. 18, 2010

(51) Int. Cl.
*A63B 22/04* (2006.01)

(52) U.S. Cl. ..... 482/53

(58) Field of Classification Search ..... 482/51–53
See application file for complete search history.

(56) References Cited

U.S. PATENT DOCUMENTS

| | | | | |
|---|---|---|---|---|
| 5,545,111 | A * | 8/1996 | Wang et al. | 482/53 |
| 5,628,709 | A * | 5/1997 | Chen | 482/53 |
| 6,102,833 | A * | 8/2000 | Chen | 482/53 |
| 6,224,515 | B1 * | 5/2001 | Chen | 482/53 |
| 6,315,697 | B1 * | 11/2001 | Chen | 482/53 |
| 6,899,658 | B1 * | 5/2005 | Chuang | 482/53 |
| 7,041,037 | B2 * | 5/2006 | Huang | 482/53 |
| 7,048,675 | B1 * | 5/2006 | Liang | 482/53 |
| 7,384,378 | B2 * | 6/2008 | Chen | 482/53 |
| 7,462,137 | B2 * | 12/2008 | Yang et al. | 482/53 |
| 7,465,255 | B2 * | 12/2008 | Chen | 482/53 |
| 7,530,927 | B2 * | 5/2009 | Chuang | 482/53 |
| 7,935,027 | B2 * | 5/2011 | Graber | 482/51 |
| 2003/0199365 | A1 * | 10/2003 | Hong | 482/53 |
| 2004/0092368 | A1 * | 5/2004 | Gramaccioni | 482/70 |
| 2005/0070403 | A1 * | 3/2005 | Yu | 482/53 |
| 2005/0227818 | A1 * | 10/2005 | Liao | 482/53 |
| 2005/0288156 | A1 * | 12/2005 | Liao | 482/52 |
| 2006/0019801 | A1 * | 1/2006 | Zeng | 482/52 |
| 2006/0229166 | A1 * | 10/2006 | Fan | 482/53 |
| 2008/0026916 | A1 * | 1/2008 | Chuang et al. | 482/53 |
| 2011/0071006 | A1 * | 3/2011 | Lai | 482/53 |

* cited by examiner

*Primary Examiner* — Stephen Crow

(57) ABSTRACT

A dual-mode exercise machine includes a base, a swivel, two pedals, two impedance elements, a linkage and a pin. The swivel is pivotally connected to the base. The pedals are pivotally connected to the swivel. Each impedance element connects a related pedal to the swivel. The linkage includes a middle lever pivotally connected to the base and two lateral levers each for connecting a related pedal to the middle lever so that the pedals can be pivoted up and down alternately. The pin can be inserted in an aperture of the swivel and an aperture of the base to prevent the pivotal of the swivel but allow the pivotal of the middle lever. Alternatively, the pin can be inserted in an aperture of the middle lever and another aperture of the base to prevent the pivotal of the middle lever but allow the pivotal of the swivel.

11 Claims, 12 Drawing Sheets

DUAL-MODE EXERCISE MACHINE

BACKGROUND OF INVENTION

1. Field of Invention

The present invention relates to a dual-mode exercise machine.

2. Related Prior Art

As disclosed in Taiwanese Patent Publication No. 324954, a conventional stepper includes two pedals that can be pivoted up and down about horizontal axles. The movement of the pedals is limited to vertical directions. Hence, a user can only exercise his or her legs with the conventional stepper.

As disclosed in Taiwanese Patent No. M271593, another conventional stepper includes two pedals that can be pivoted about two inclined axles extending from a post. The inclined axles and the post form a Y-shaped structure. One of the pedals will be lifted and moved toward the post if the other pedal is trodden and moved away from the post, i.e., outward. Therefore, a user is forced to twist his or her waist while exercising his or her legs by treading the pedals. The user uses a little energy to twist his or her waist because he or she easily keeps balance while moving the pedal downward and outward.

Either of the conventional steppers provides a single mode, and would soon bore the user. The user might soon stop working out with it.

The present invention is therefore intended to obviate or at least alleviate the problems encountered in prior art.

SUMMARY OF INVENTION

It is the primary objective of the present invention to provide a dual-mode exercise machine.

To achieve the foregoing objective, the dual-mode exercise machine includes a base, a swivel, two pedals, two impedance elements, a linkage and a pin. The base includes first and second apertures defined therein. The swivel is pivotally connected to the base, and includes an aperture defined therein. The pedals are pivotally connected to the swivel. Each of the impedance elements connects a related one of the pedals to the swivel. The linkage includes a middle lever and two lateral levers. The middle lever includes an aperture defined therein, and is pivotally connected to the base. Each of the lateral levers connects a related one of the pedals to the middle lever so that the pedals can be pivoted up and down alternately. A pin can be inserted in the aperture of the swivel and the first aperture of the base to prevent the pivotal of the swivel but allow the pivotal of the middle lever. Alternatively, the pin can be inserted in the aperture of the middle lever and the second aperture of the base to prevent the pivotal of the middle lever but allow the pivotal of the swivel.

Other objectives, advantages and features of the present invention will be apparent from the following description referring to the attached drawings.

BRIEF DESCRIPTION OF DRAWINGS

The present invention will be described via the detailed illustration of the preferred embodiment referring to the drawings wherein:

FIG. 10 is a perspective view of the dual-mode exercise machine shown in

FIG. 9;

DETAILED DESCRIPTION OF PREFERRED EMBODIMENT

Figure 1:
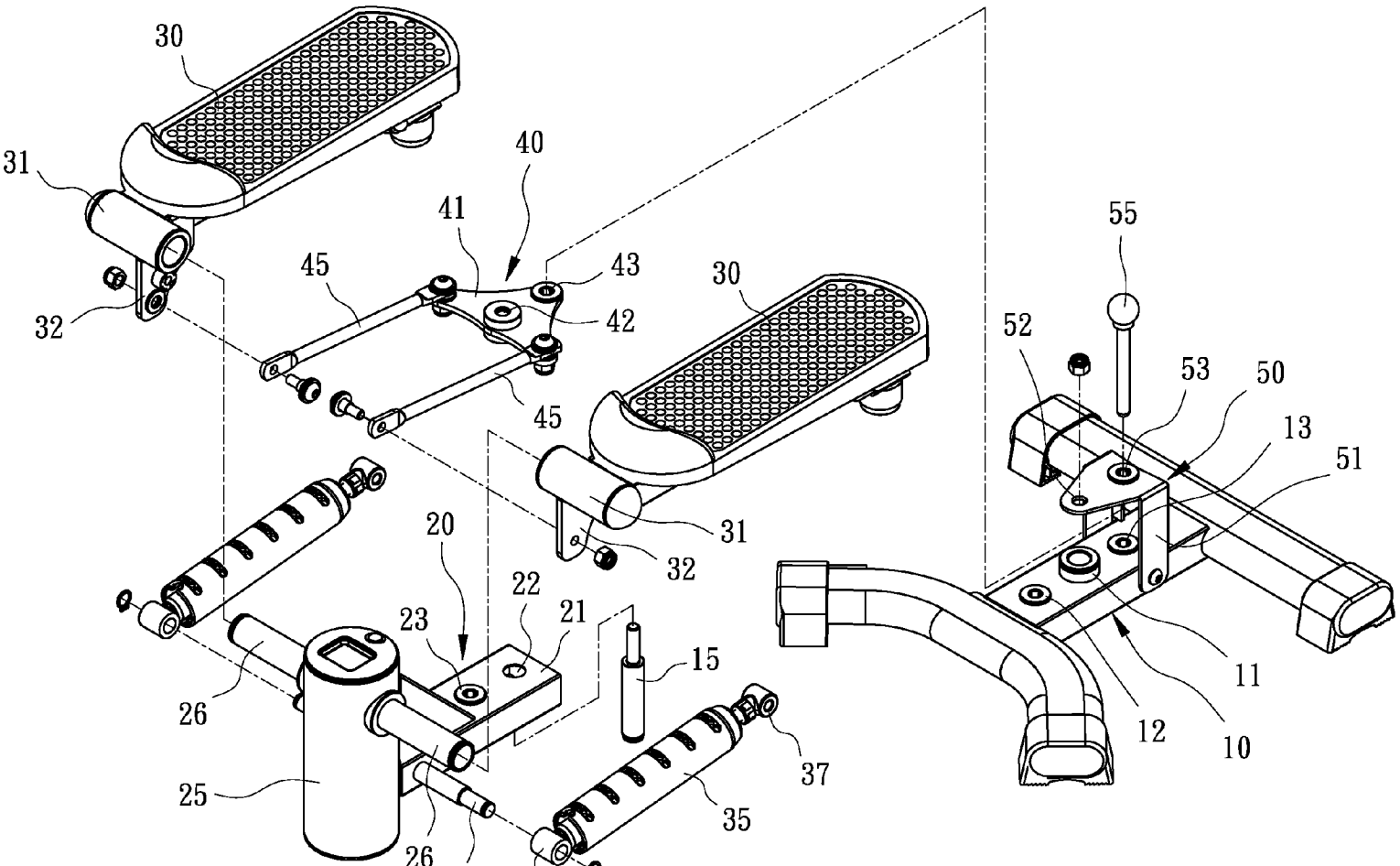
FIG. 1 is an exploded view of a dual-mode exercise machine according to the preferred embodiment of the present invention.
Figure 2:
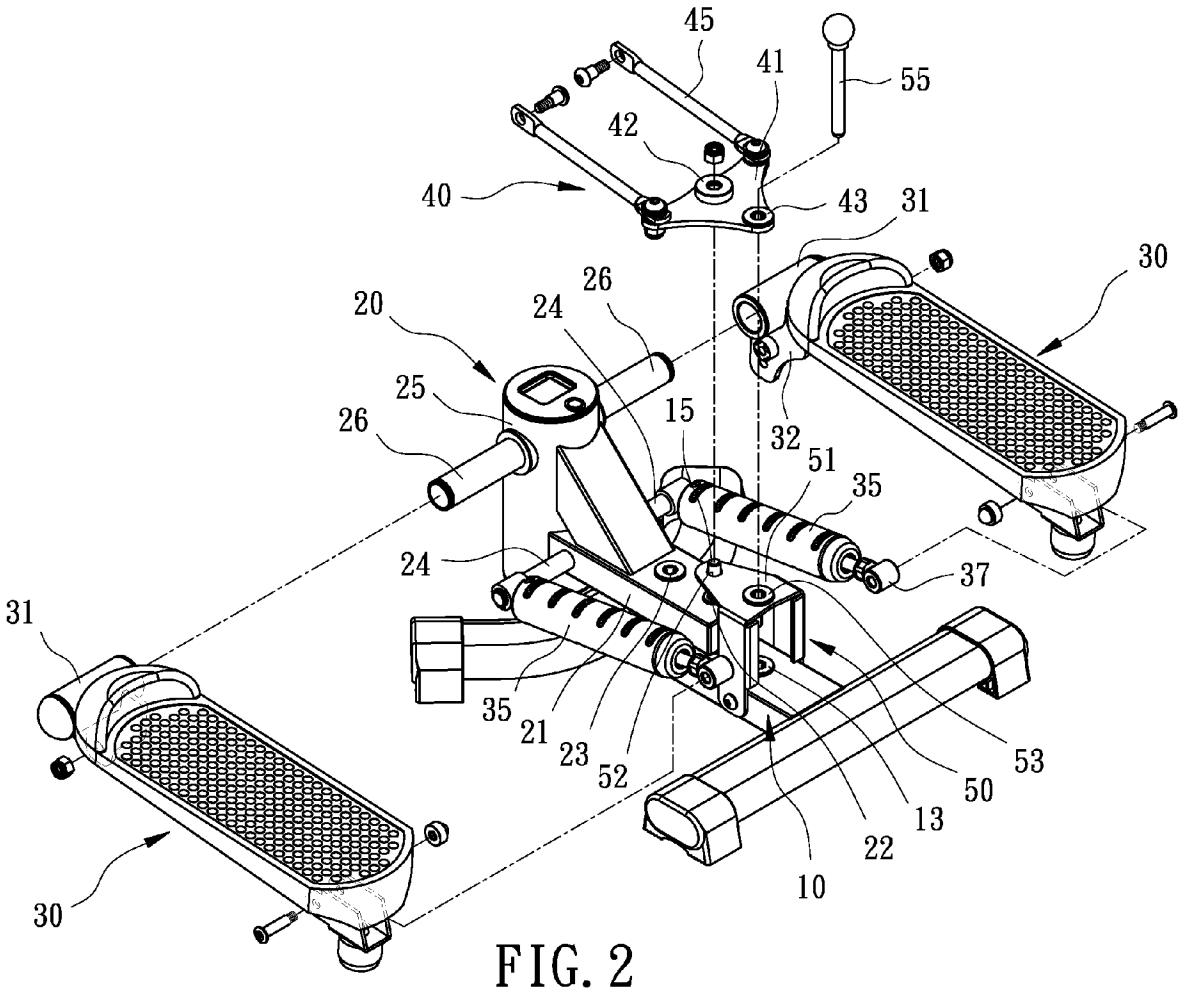
FIG. 2 is another exploded view of the dual-mode exercise machine shown in FIG. 1.
Figure 3:
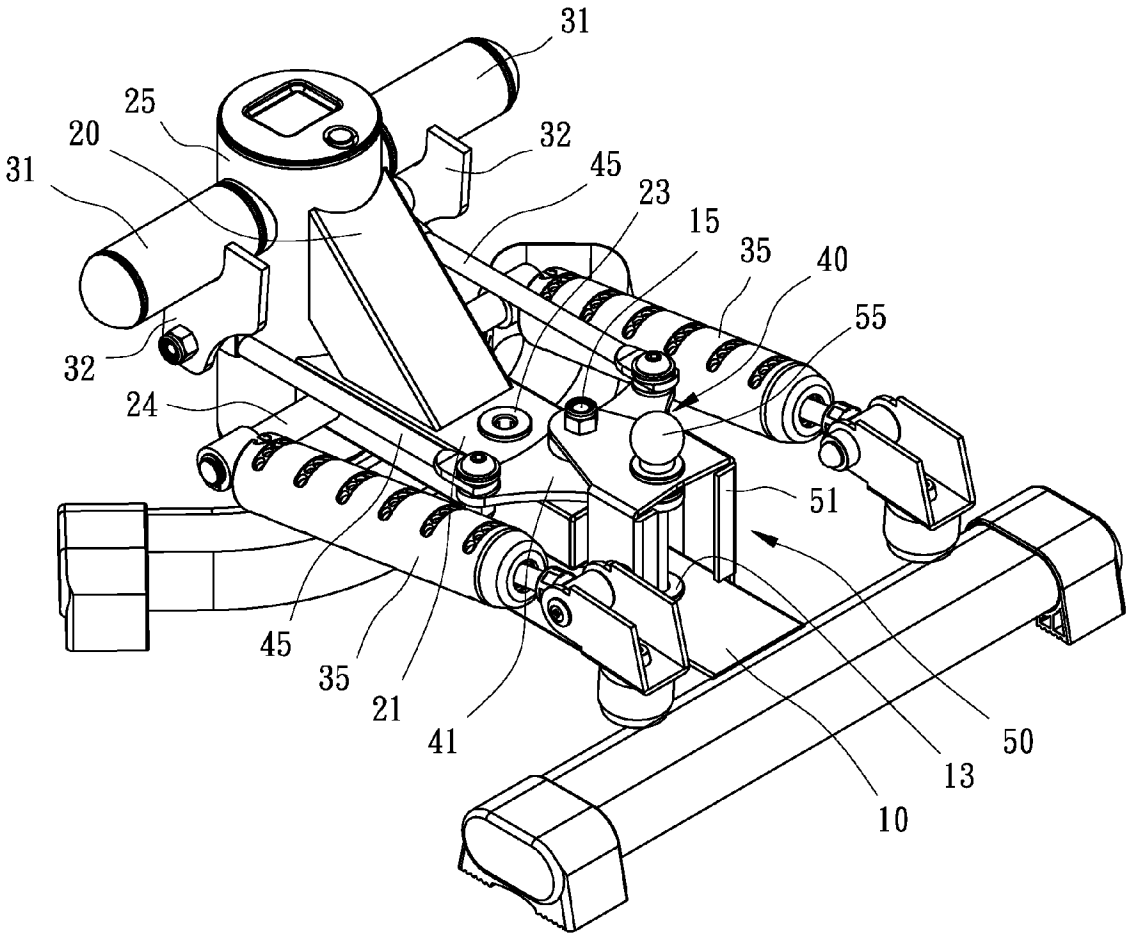
FIG. 3 is a perspective view of the dual-mode exercise machine without two pedals shown in FIG. 1.
Figure 4:
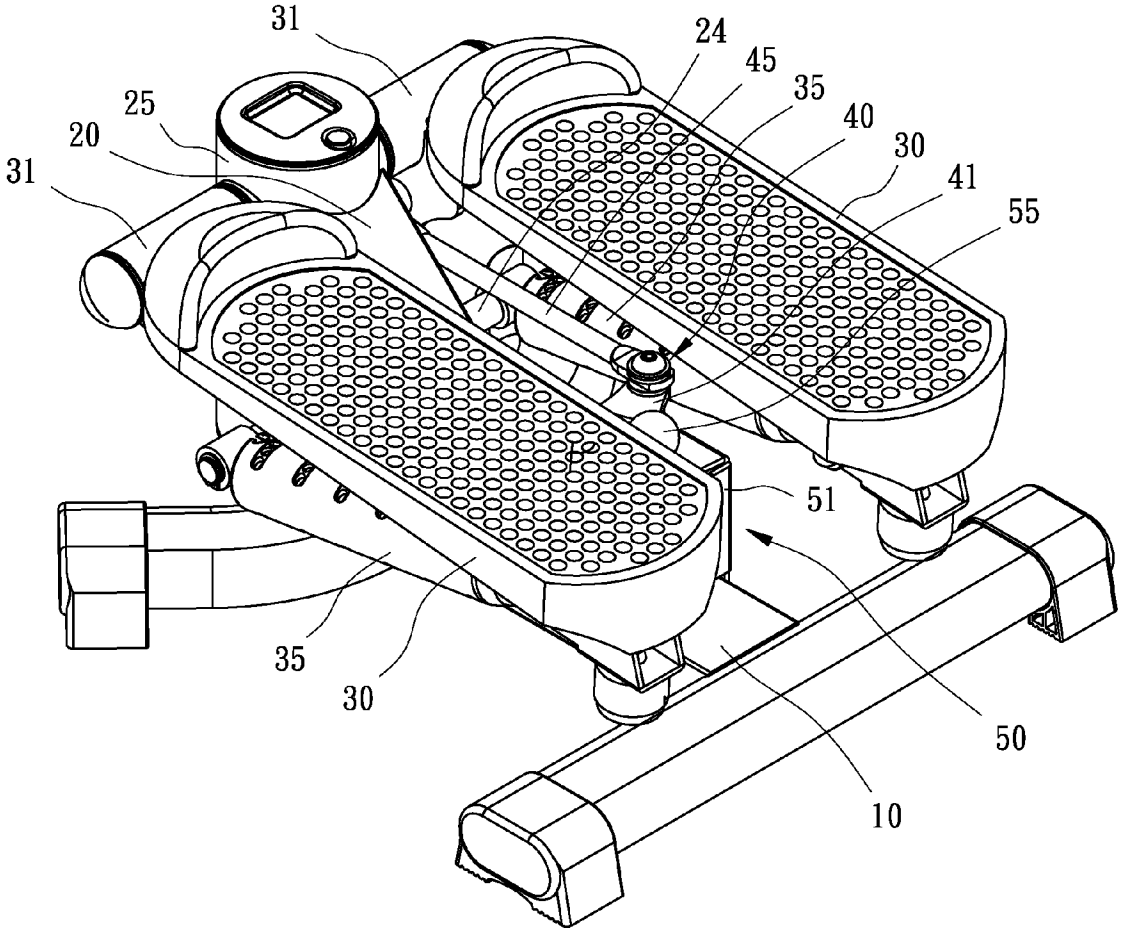
FIG. 4 is a perspective view of the dual-mode exercise machine shown in FIG. 1.

Referring to FIGS. 1 through 4, a dual-mode exercise machine includes a base 10, a swivel 20, two pedals 30, two impedance elements 35, a linkage 40 and a switching unit 50 according to the preferred embodiment of the present invention. The base 10 includes a longitudinal bar extending between front and rear crossbars. Thus, the base 10 can firmly be located on the ground or a floor. The base 10 includes middle, front and rear apertures 11, 12 and 13 defined in the longitudinal bar.

The swivel 20 includes a beam 21 extending from a post 25, two lower pivots 24 extending from the beam 21 in opposite directions, and two upper pivots 26 extending from the post 25 in opposite directions. Two apertures 22 and 23 are defined in the beam 21 corresponding to the apertures 11 and 12, respectively. The lower pivots 24 are perpendicular to the upper pivots 26.

Each of the pedals 30 includes a bushing 31 connected to a front end and a fin 32 extending from a lower face. The length of each pedal 30 is perpendicular to the axis of the bushing 31. A plane in which each pedal 30 extends is perpendicular to a plane in which the fin 32 extends.

Each of the impedance elements 35 includes two universal joints 36 and 37 each connected to an end. The impedance elements 35 are springs, pneumatic cylinders or hydraulic cylinders. The impedance elements 35 are preferably hydraulic cylinders.

The linkage 40 includes a middle lever 41 pivotally connected to two lateral levers 45. The middle lever 41 is a triangular plate with apertures 42 and 43 defined therein corresponding to the apertures 11 and 13, respectively.

The switching unit 50 includes a frame 51 and a pin 55. The frame 51 includes a roof extending between two walls. Two apertures 52 and 53 are defined in the roof of the frame 51 corresponding to the aperture 43 of the middle lever 41 of the linkage 40 and the rear aperture 13 of the longitudinal bar of the base 10. Each of the walls of the frame 51 is pivotally connected to the longitudinal bar of the base 10.

In assembly, an axle 15 is inserted in the aperture 52 of the frame 51, the aperture 42 of the middle lever 41, the aperture 22 of the beam 21 and the middle aperture 11 of the base 10, sequentially. Thus, the linkage 40 and the swivel 20 are pivotally connected to the base 10.

Each of the bushings 31 is pivotally located on a related one of the upper pivots 26. Thus, the pedals 30 are pivotally connected to the post 25 of the swivel 20. Each of the fins 32 is pivotally connected to a related one of the lateral levers 45. Thus, the pedals 30 are pivotally connected to each other via the linkage 40. One of the pedals 30 is pivoted downward while the other pedal 30 is pivoted upward because of the linkage 40.

The universal joint 36 of each of the impedance elements 35 is connected to a related one of the lower pivots 24. The universal joint 37 of each of the impedance elements 35 is connected to a related one of the pedals 30. Thus, each of the impedance elements 35 is provided between a related one of the pedals 30 and the beam 21 of the swivel 20. While treading each of the pedals 30, a user encounters resistance from a related one of the impedance elements 35 for the purposes of exercise.

Figure 5:
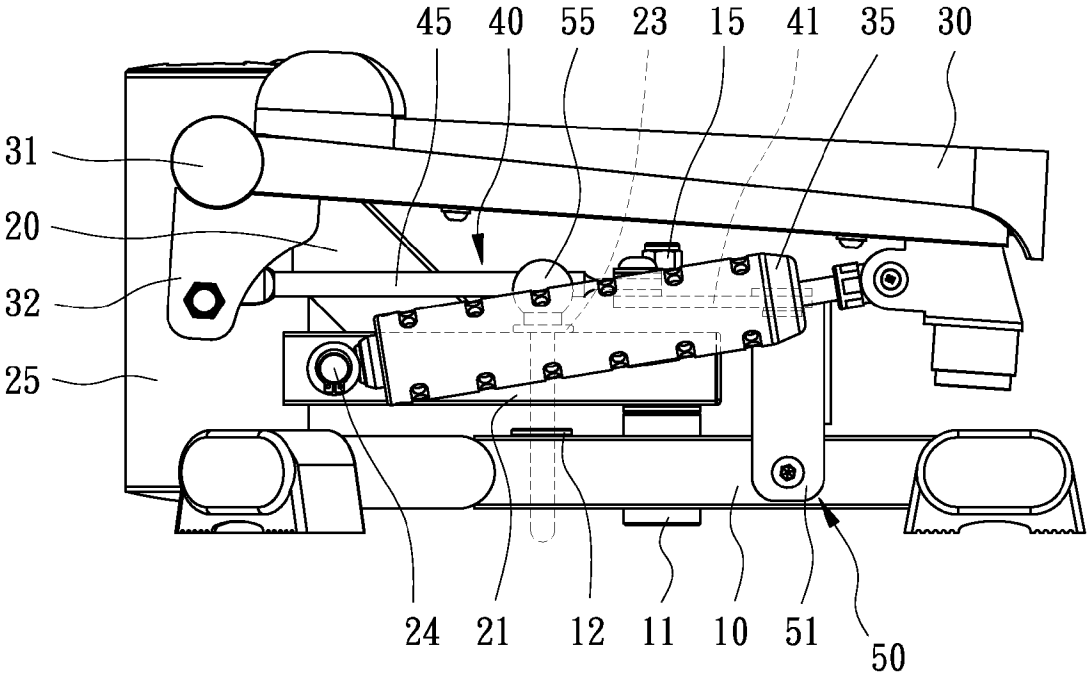
FIG. 5 is a side view of the dual-mode exercise machine shown in FIG. 1 in a mode.
Figure 6:
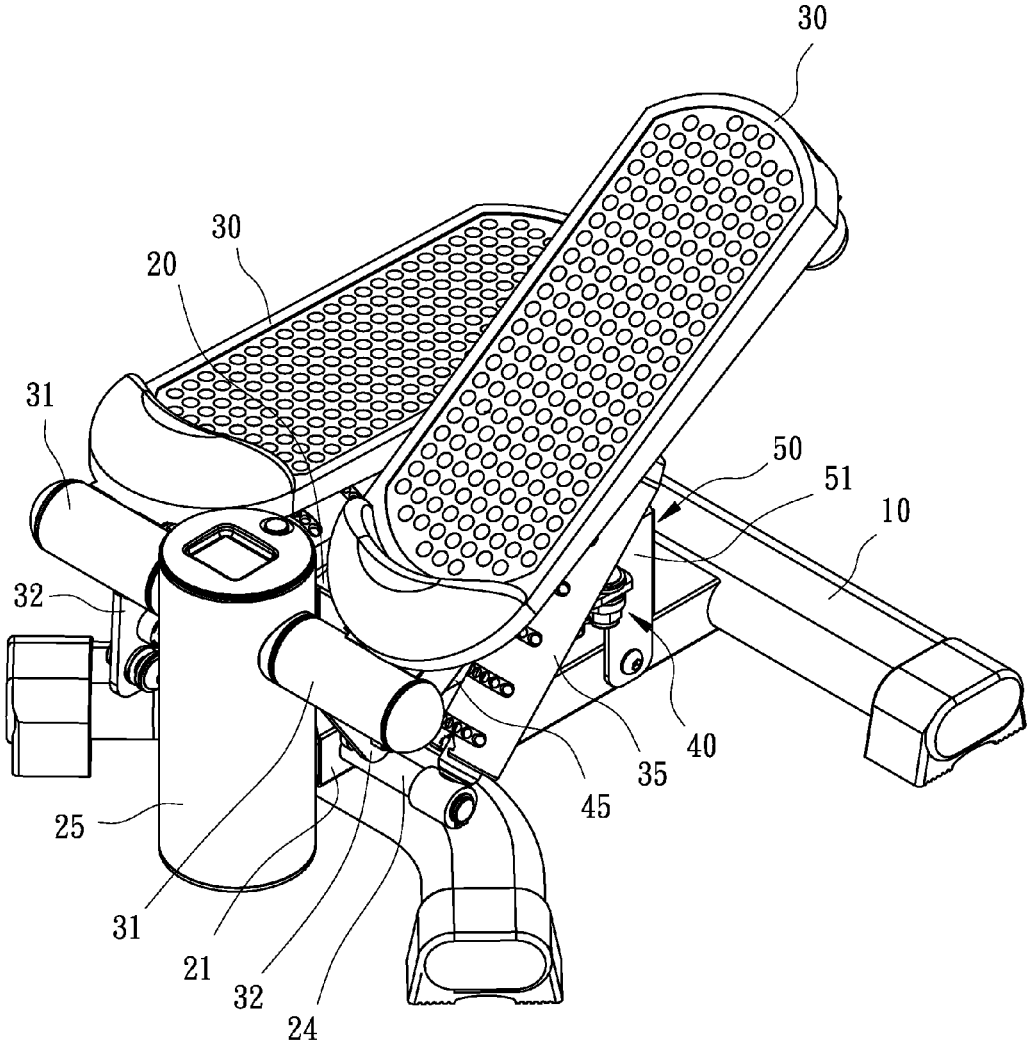
FIG. 6 is a perspective view of the dual-mode exercise machine shown in FIG. 5.
Figure 7:
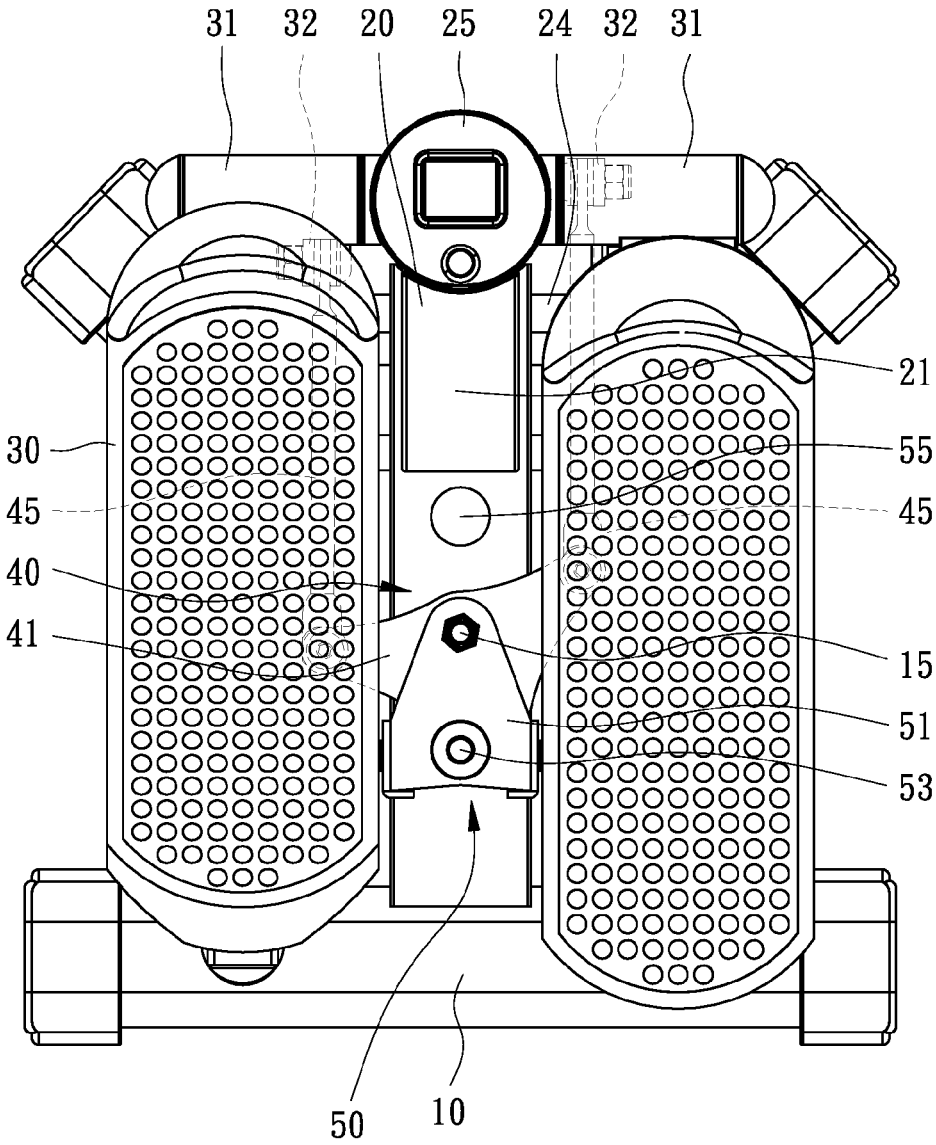
FIG. 7 is a top view of the dual-mode exercise machine shown in FIG. 5.
Figure 8:
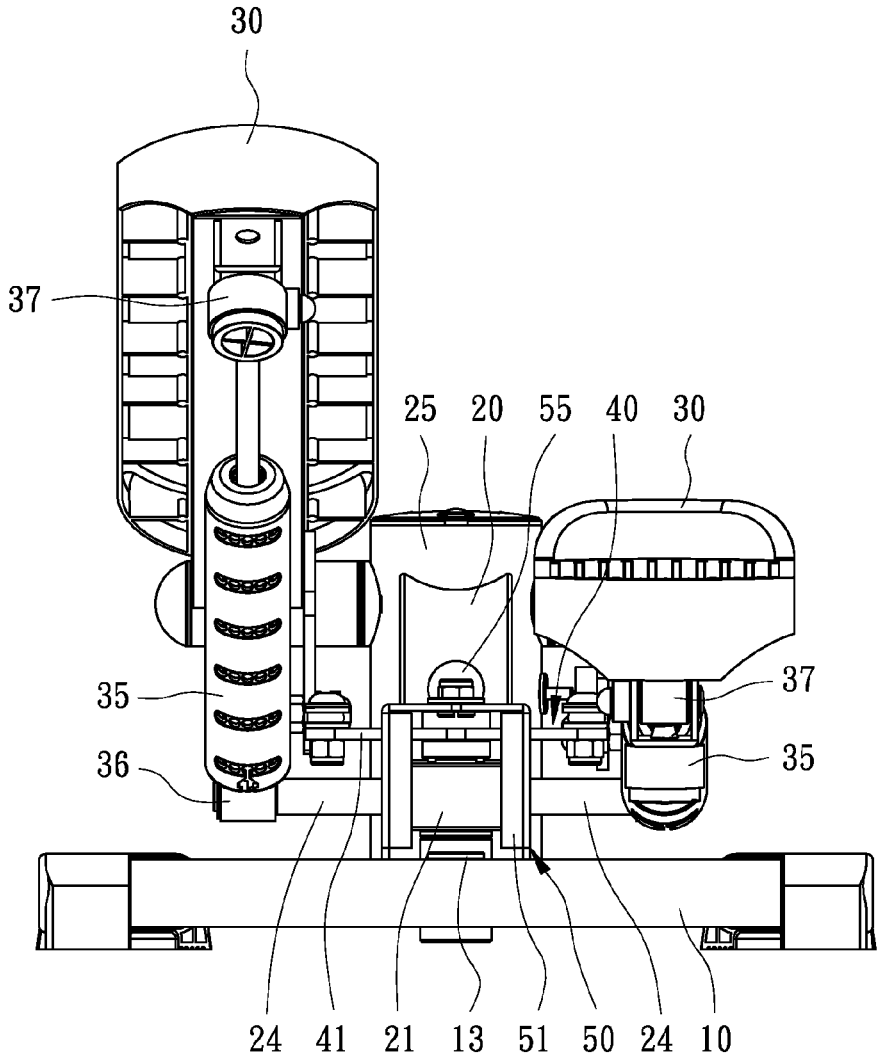
FIG. 8 is a rear view of the dual-mode exercise machine shown in FIG. 5.
Figure 9:
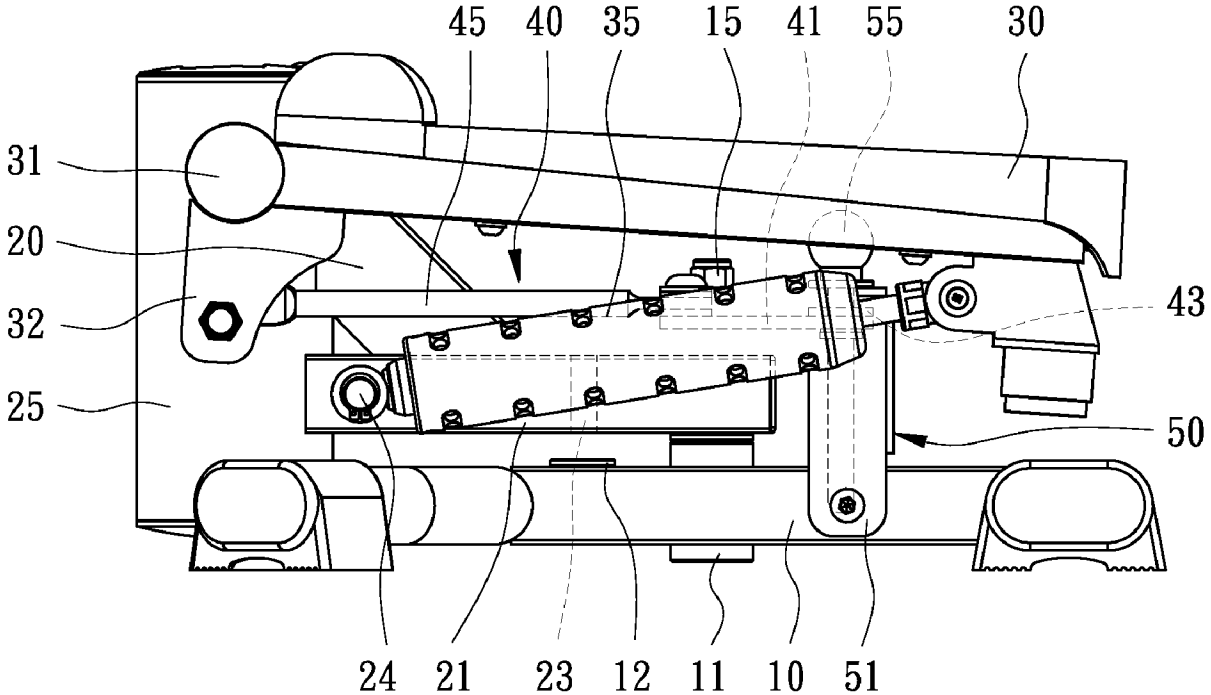
FIG. 9 is a side view of the dual-mode exercise machine shown in FIG. 1 in another mode.

Referring to FIGS. 5 to 9, the pin 55 is sequentially inserted in the aperture 23 of the beam 21 of the swivel 20 and the front aperture 12 of the longitudinal bar of the base 10. Thus, the swivel 20 is kept in position relative to the base 10, i.e., the swivel 20 cannot be pivoted relative to the base 10. The dual-mode exercise machine is in a first mode. The user can exercise with the dual-mode exercise machine by treading the pedals 30 alternately.

Figure 10:
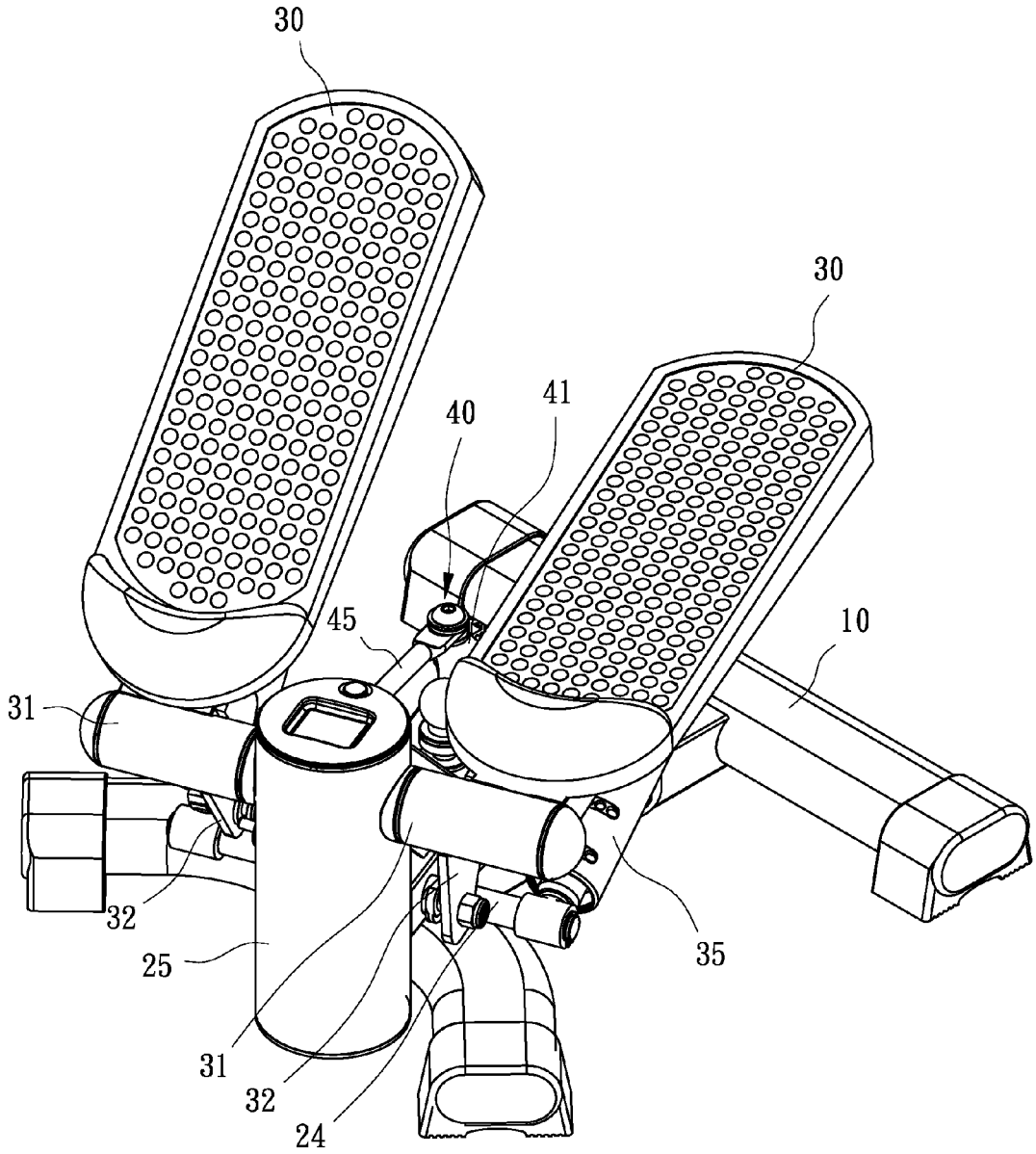
Figure 11:
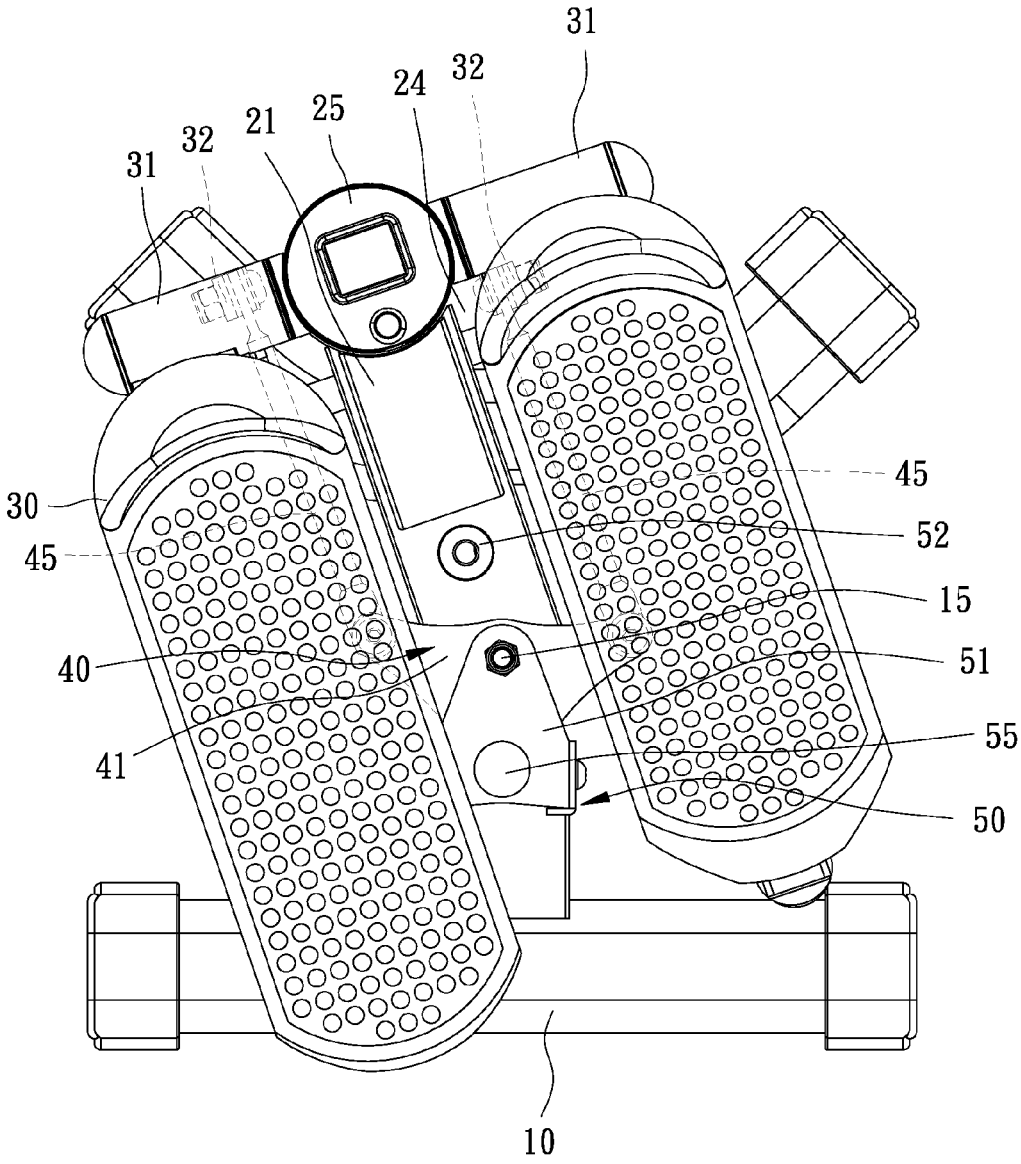
FIG. 11 is a top view of the dual-mode exercise machine shown in FIG. 9.
Figure 12:
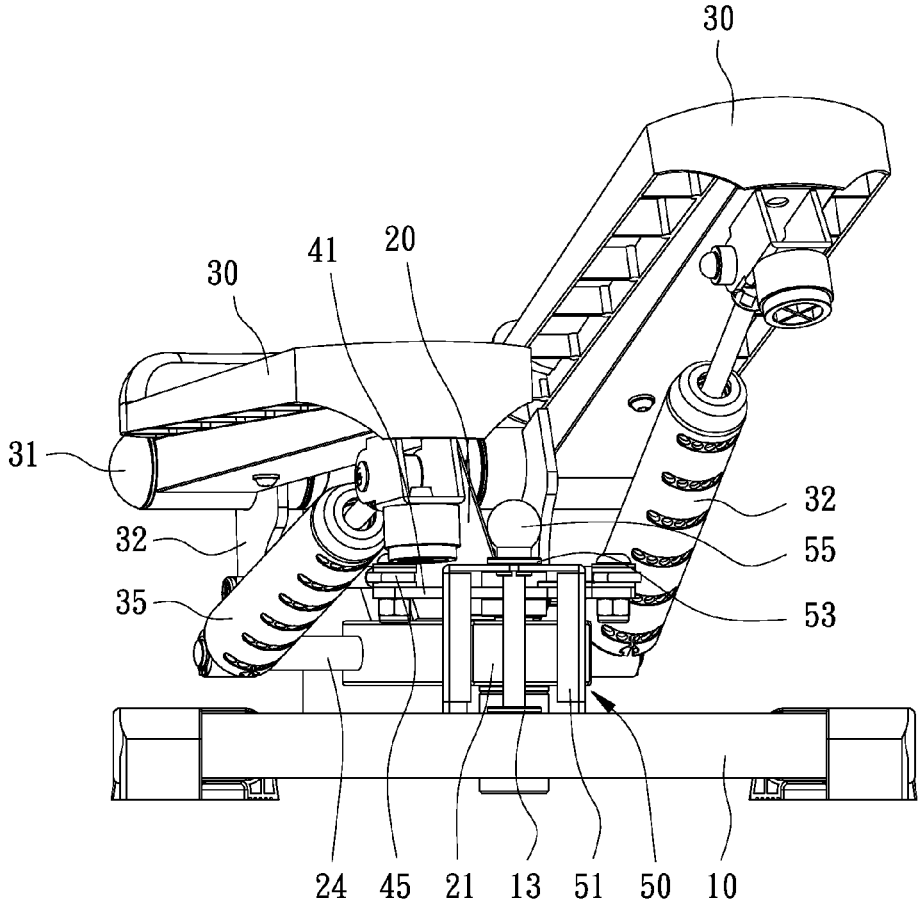
FIG. 12 is a rear view of the dual-mode exercise machine shown in FIG. 9.

Referring to FIGS. 9 through 12, the pin 55 is sequentially inserted in the aperture 53 of the frame 51 of the switching unit 50, the aperture 43 of the middle lever 41 of the linkage 40 and the rear aperture 13 of the longitudinal bar of the base 10. Thus, the middle lever 41 of the linkage 40 is retained in position relative to the base 10, i.e., the middle lever 41 of the linkage 40 cannot be pivoted relative to the base 10. However, the lateral levers 45 of the linkage 40 can be pivoted relative to the base 10. The swivel 20 can be pivoted relative to the base 10. The dual-mode exercise machine is in a second mode.

When the user treads the left pedal 30, the left pedal 30 pushes the left impedance element 35. The left impedance element 35 pivots the swivel 20. The swivel 20 pushes the right impedance element 35. The right impedance element 35 lifts the right pedal 30.

When the user treads the right pedal 30, the right pedal 30 pushes the right impedance element 35. The right impedance element 35 pivots the swivel 20. The swivel 20 pushes the left impedance element 35. The left impedance element 35 lifts the left pedal 30.

As discussed above, each of the pedals 30 is pivoted about horizontal and vertical axes. Thus, the user can exercise the legs by treading the pedals 30 alternately and exercise the hips and waist by twisting.

The present invention has been described via the detailed illustration of the preferred embodiment. Those skilled in the art can derive variations from the preferred embodiment without departing from the scope of the present invention. Therefore, the preferred embodiment shall not limit the scope of the present invention defined in the claims.

The invention claimed is:

1. A dual-mode exercise machine including:

a base including first and second apertures defined therein;

a swivel pivotally connected to the base, wherein the swivel includes an aperture defined therein;

two pedals pivotally connected to the swivel;

two impedance elements each for connecting a respective one of the pedals to the swivel;

a linkage including:

a middle lever pivotally connected to the base and formed with an aperture defined therein; and two lateral levers each for connecting a respective one of the pedals to the middle lever so that the pedals can be pivoted up and down alternately; and a pin for insertion in the aperture of the swivel and the first aperture of the base to prevent the pivoting of the swivel but allow the pivoting of the middle lever and for insertion in the aperture of the middle lever and the second aperture of the base to prevent the pivoting of the middle lever but allow the pivoting of the swivel.

2. The dual-mode exercise machine according to claim 1, including an axle inserted in the base, the swivel and the middle lever.

3. The dual-mode exercise machine according to claim 2, wherein the base includes another aperture for receiving the axle.

4. The dual-mode exercise machine according to claim 2, wherein the swivel includes another aperture for receiving the axle.

5. The dual-mode exercise machine according to claim 2, wherein the middle lever includes another aperture for receiving the axle.

6. The dual-mode exercise machine according to claim 1, including a frame connected to the base and made with an aperture through which the pin can be inserted in the aperture of the middle lever and the second aperture of the base.

7. The dual-mode exercise machine according to claim 1, wherein the swivel includes a post pivotally connected to the base and a beam extending from the post.

8. The dual-mode exercise machine according to claim 7, wherein the post includes two pivots each for supporting a respective one of the pedals.

9. The dual-mode exercise machine according to claim 7, wherein the beam includes two pivots each connected to a respective one of the impedance elements.

10. The dual-mode exercise machine according to claim 9, wherein each of the impedance elements includes a universal joint connected to a respective one of the pivots.

11. The dual-mode exercise machine according to claim 9, wherein each of the impedance elements includes a universal joint connected to a respective one of the pedals.

* * * * *